US011688577B2

(12) United States Patent
Hong

(10) Patent No.: US 11,688,577 B2
(45) **Date of Patent: *Jun. 27, 2023**

(54) HIGH-VOLTAGE DIRECT-CURRENT THERMAL FUSE

(71) Applicant: XIAMEN SET ELECTRONICS CO., LTD, Xiamen (CN)

(72) Inventor: Yaoxiang Hong, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/329,182

(22) Filed: May 25, 2021

(65) Prior Publication Data

US 2021/0280382 A1 Sep. 9, 2021

Related U.S. Application Data

(63) Continuation-in-part of application No. 16/623,932, filed as application No. PCT/CN2018/101788 on Aug. 22, 2018, now Pat. No. 11,049,683.

(30) Foreign Application Priority Data

Jun. 30, 2017 (CN) ..... 201720786629.2

(51) Int. Cl.
*H01H 85/12* (2006.01)
*H01H 85/165* (2006.01)
(Continued)

(52) U.S. Cl.
CPC ..... *H01H 85/12* (2013.01); *H01H 85/143* (2013.01); *H01H 85/165* (2013.01); *H01H 85/38* (2013.01)

(58) Field of Classification Search
CPC .... H01H 85/12; H01H 85/143; H01H 85/165; H01H 85/38; H01H 85/153;
(Continued)

(56) References Cited

U.S. PATENT DOCUMENTS 6,838,971 B2 * 1/2005 Senda ..... H01H 37/761 337/296
6,873,243 B1 * 3/2005 Karnes ..... H01H 85/0411 337/276
(Continued)

FOREIGN PATENT DOCUMENTS

CN 110047718 A * 7/2019 ..... H01H 85/06

OTHER PUBLICATIONS

Li, Xin, "A Two-section Tolerance of Lightning Current Fuse Structure and Fuse Using The Structure", Jul. 23, 2019, Xiamen Taihang Technology Co., Ltd, Entire Document (Translation of CN 110047718). (Year: 2019).*

*Primary Examiner* — Stephen S Sul
(74) *Attorney, Agent, or Firm* — Bayramoglu Law Offices LLC

(57) ABSTRACT

A high-voltage direct-current thermal fuse includes one or more fusible components each having two fusible alloy support arms, a fluxing agent, a fusing cavity, two pins, and an insulation block. Two fusible alloy support arms are arranged opposite, and the fusible component is U-shaped. The fusible component and the fluxing agent are sealed within the fusing cavity. The two pins are respectively connected to the two fusible alloy support arms. The insulation block is arranged between the two fusible alloy support arms and separates the two pins. A volume ratio of the fluxing agent to the fusing cavity is approximately 50% or less, preferably, 10%-50%. The number of the one or more fusible components is at least two, and the at least two fusible components are arranged separately. The thermal
(Continued)

fuse can avoid the burst and quickly cut off the current, which provides effective thermal protection for a circuit.

11 Claims, 4 Drawing Sheets

(51) Int. Cl.
*H01H 85/38* (2006.01)
*H01H 85/143* (2006.01)

(58) Field of Classification Search
CPC ..... H01H 85/175; H01H 85/18; H01H 2085/383; H01H 85/08
See application file for complete search history.

(56) References Cited

U.S. PATENT DOCUMENTS

| | | | | |
|---|---|---|---|---|
| 8,633,795 | B2 * | 1/2014 | Knab | H05K 1/0293 337/296 |
| 10,109,439 | B2 * | 10/2018 | Komori | H01H 37/761 |
| 11,049,683 | B2 * | 6/2021 | Hong | H01H 85/38 |
| 2001/0048579 | A1 * | 12/2001 | Kanamaru | H01H 85/0411 361/103 |
| 2002/0181221 | A1 * | 12/2002 | Ries | H01H 85/306 361/837 |
| 2003/0001716 | A1 * | 1/2003 | Kaltenborn | H01H 85/046 337/273 |
| 2004/0166405 | A1 * | 8/2004 | Senda | H01M 50/572 429/61 |
| 2005/0030148 | A1 * | 2/2005 | Kono | H01H 37/76 337/159 |

* cited by examiner

HIGH-VOLTAGE DIRECT-CURRENT THERMAL FUSE

CROSS REFERENCE TO THE RELATED APPLICATIONS

This application is the continuation in-part application of U.S. application Ser. No. 16/623,932, filed on Dec. 18, 2019, which is the national phase entry of International Application No. PCT/CN2018/101788, filed on Aug. 22, 2018, which is based upon and claims priority to Chinese Patent Application No. 201720786629.2, filed on Jun. 30, 2017, the entire contents of which are incorporated herein by reference.

TECHNICAL FIELD

The present application relates to a fuse, in particular to a high-voltage direct-current thermal fuse.

BACKGROUND

A thermal fuse is a circuit protection device configured to cut off the current quickly. Generally, the thermal fuse contains a fusible alloy. The fusible alloy is arranged in a fusing cavity, and the fusing cavity is filled with a fluxing agent. The fluxing agent can effectively activate the oxide layer on the surface of the fusible alloy, thereby increasing the contraction rate of the fusible alloy. The existing thermal fuse typically has the fluxing agent to fill the entire fusing cavity, or at least 80% of the fusing cavity.

However, under high-voltage conditions, the fluxing agent will gasify and expand. If the amount of fluxing agent is excessive, it is likely to cause the fusing cavity to burst. If the fluxing agent amount is not enough, the oxide layer on the surface of the fusible alloy may be insufficiently activated, which fails to cut off the current quickly.

SUMMARY

In order to solve the existing problems mentioned above, the present application provides a high-voltage direct-current thermal fuse capable of avoiding the burst of the thermal cavity and quickly cutting off the current, thereby providing effective thermal protection for a circuit.

A high-voltage direct-current thermal fuse includes one or more fusible components, wherein each fusible component has two fusible alloy support arms arranged opposite to each other, and each fusible component is U-shaped;

a fluxing agent;

a fusing cavity, wherein the each fusible component and the fluxing agent are sealed within the fusing cavity;

two pins, wherein the two pins are respectively connected to the two fusible alloy support arms; and an insulation block, wherein the insulation block is arranged between the two fusible alloy support arms and separates the two pins.

The volume ratio of the fluxing agent to the fusing cavity is approximately 50% or less, preferably 10%-50%.

On the one hand, in the high-voltage direct-current thermal fuse, the amount of fluxing agent is controlled to be less than 50% of the volume of the fusing cavity, so that there is enough space for gasification in the fusing cavity, which effectively prevents the fusing cavity from bursting due to excessive fluxing agent under high voltage conditions. On the other hand, the fusible component has a U-shaped structure with two support arms arranged opposite to each other. When the arc is cut off, a high-strength electromagnetic field is generated, and the electrons repel each other, thereby elongating the arc, and quickly cutting off the arc. Further, the U-shaped fusible component increases the gap surface between the fusible component and the insulation block, thereby increasing the contact surface between the fluxing agent and the fusible component, and effectively improving the activation speed of the oxide layer on the surface of the fusible component. In this way, the contraction rate of the fusible component is accelerated to realize a rapid cutting off.

Optionally, the high-voltage direct-current thermal fuse includes at least two fusible components, and the at least two fusible components are arranged separately. The cross-sectional area of at least one fusible component is smaller than the cross-sectional areas of the other fusible components. The operating temperature of a fusible component having a small cross-sectional area is higher than the operating temperature of a fusible component having a large cross-sectional area.

Through the above arrangement, the flow per unit volume increases and the ability to cut off high voltage is enhanced. The fusible component with a high operating temperature and a small cross-sectional area can rapidly contract and cut off the arc due to the temperature and the current after the other fusible components are fused.

Optionally, the fusible components with different cross-sectional areas have an operating temperature difference of no less than 5° C., so as to ensure the fusible components in the same fusing cavity are fused in order.

Optionally, the high-voltage direct-current thermal fuse further includes a housing and a bottom plate. The insulation block is arranged on the bottom plate. The housing, the bottom plate, the insulation block, and the two pins form the fusing cavity.

Optionally, a fusible alloy connection segment is connected between the two fusible alloy support arms, and the two fusible alloy support arms and the fusible alloy connection segment together form the U-shaped structure.

Optionally, the two pins are perpendicular to the two fusible alloy support arms.

Optionally, a non-metallic partition film is arranged inside the fusing cavity to divide the fusing cavity into an inner cavity and an outer cavity, and the inner cavity and the outer cavity are mutually sealed; the fluxing agent is arranged inside the inner cavity, and an arc-extinguishing medium is arranged inside the outer cavity. Specifically, the arc-extinguishing medium is quartz sand. In high voltage application, the arc cutting process easily gasifies and expands the fluxing agent. The arc-extinguishing medium can absorb the impact of gasification and block the transmission path of the arc, which is favorable for improving the insulation withstanding voltage of the opening points. Further, the fusible component may have a hollow tube structure, and the fluxing agent is placed inside the tube. By doing so, the surface oxide layer of the fusible component can be activated more effectively, and the arc can be cut off quickly.

Further, each of the two pins has a flat end and a wavy end. The flat end configured for external connection is away from the fusing cavity, and the wavy end is close to the fusing cavity.

The present application has the following advantages.

The fusible components of the high-voltage direct-current thermal fuse in this application is a U-shaped structure having two support arms arranged opposite to each other. A high electric field intensity is generated when an arc is being cut off, as a result, the electrons repel each other, and the arc is lengthened, thereby increasing the speed of cutting off the arc. Therefore, this invention can be used to provide thermal protection for high-voltage direct-current power devices. When an abnormal heating condition occurs and the temperature reaches the operating temperature point of the fusible alloy, the cutting off operation can be performed quickly to protect the circuit, therefore providing a safe operating condition.

BRIEF DESCRIPTION OF THE DRAWINGS

The present application will be further described below with reference to the following drawings.

Figure 1:
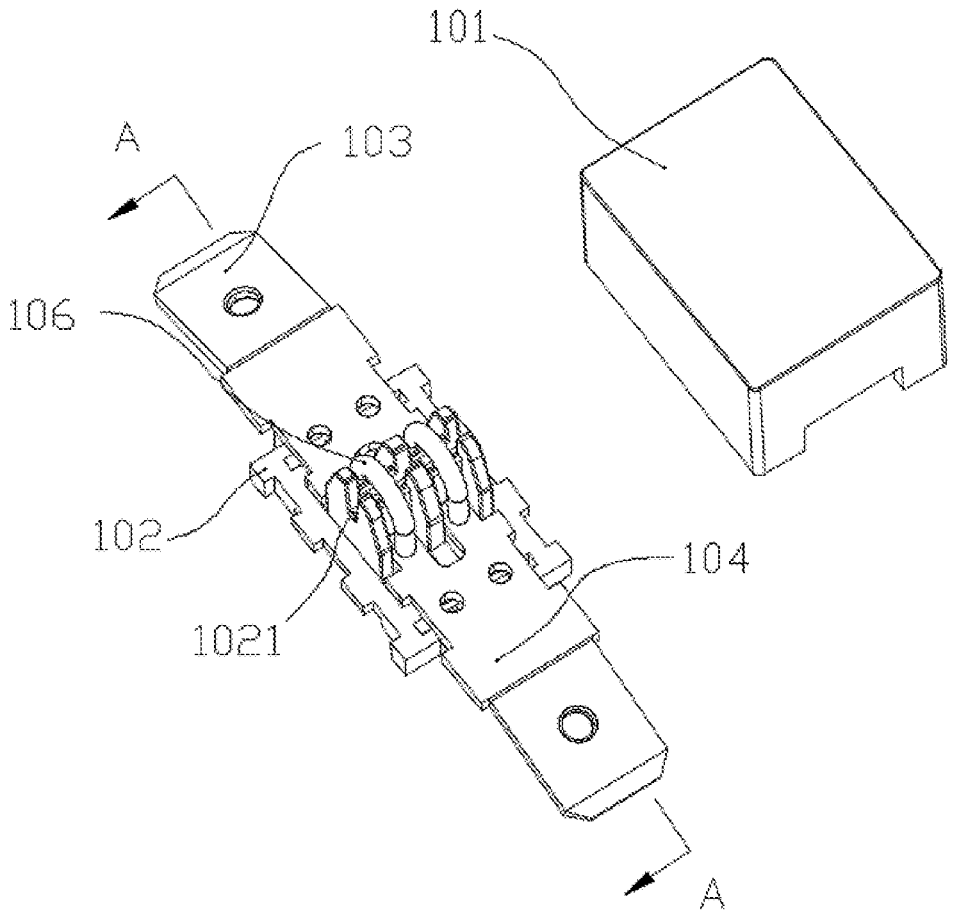
FIG. 1 is a perspective view of the high-voltage direct-current thermal fuse with the housing removed according to Embodiment 1 in the present application.
Figure 2:
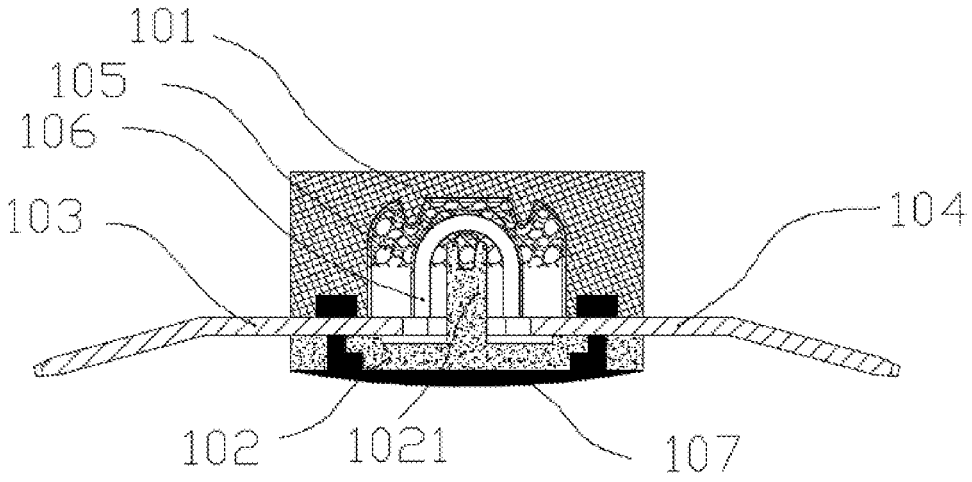
FIG. 2 is a cross-sectional view taken from the line A-A in FIG. 1 according to Embodiment 1 in the present application.
Figures 3A, 3B, 3C, 3D:
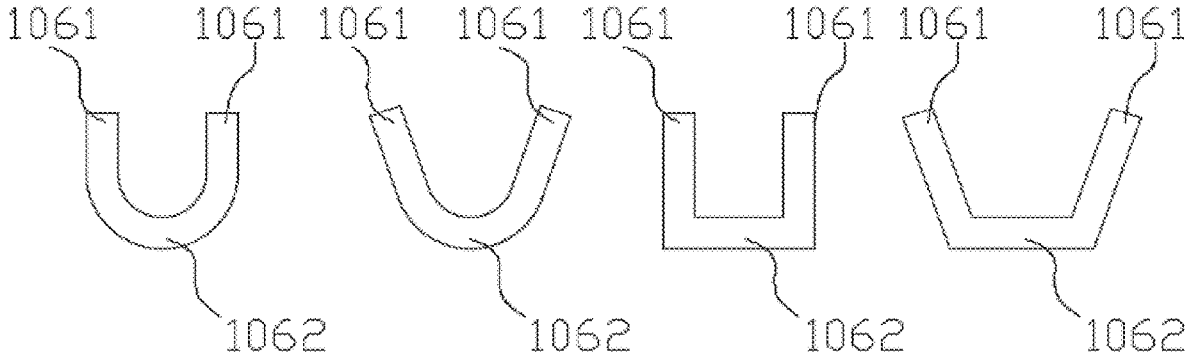
FIGS. 3A-3D show different types of the U-shaped structure of the fusible component of the high-voltage direct-current thermal fuse according to Embodiment 1 in the present application.

The reference numerals in the drawings are illustrated below:

101 housing
102 bottom plate
1021 insulation block
103 left pin
1031 flat end
1032 wavy end
104 right pin
105 fluxing agent
106 fusible component
1061 fusible alloy support arm
1062 fusible alloy connection segment
107 encapsulation adhesive
201 housing
202 bottom plate
2021 insulation block
203 pin
204 fluxing agent
205 first fusible component
206 second fusible component
207 encapsulation adhesive
301 housing
302 bottom plate
303 left pin
304 right pin
305 fluxing agent
306 fusible component
307 encapsulation adhesive
308 non-metallic partition film
309 quartz sand

DETAILED DESCRIPTION OF THE EMBODIMENTS

Embodiment 1

As shown in FIG. 1, FIG. 2 and FIGS. 3A-3D, the high-voltage direct-current thermal fuse includes the non-metallic housing 101, the bottom plate 102, and the insulation block 1021 arranged on the bottom plate 102. The housing 101 and the bottom plate 102 are sealed with the encapsulation adhesive 107. The housing 101, the bottom plate 102, the left pin 103, the right pin 104, and the insulation block 1021 form the fusing cavity, at least one fusible component 106 having a U-shaped structure are arranged in the fusing cavity. The fusible component 106 includes two fusible alloy support arms 1061 opposite to each other and the fusible alloy connection segment 1062 connecting the two support arms 1061. The two fusible alloy support arms 1061 and the fusible alloy connection segment 1062 both are fusible alloy, namely, the fusible component 106 is a U-shaped fusible alloy. The insulation block 1021 is arranged between the two support arms 1061 and separates the left pin 103 and the right pin 104.

It should be noted that the U-shaped structure described in the present application includes, but is not limited to, two support arms 1061 parallel or non-parallel to each other, and the connection between the two support arms 1061 and the fusible alloy connection segment 1062 is arc-shaped, right-angled, or obtuse-angled, as shown in FIGS. 3A-3D.

The fluxing agent 105 is further provided in the fusing cavity, and the volume ratio of the fluxing agent 105 to the fusing cavity is approximately 50% or less.

On the one hand, the amount of fluxing agent 105 is controlled to be less than 50% of the volume of the fusing cavity, so that there is enough space for gasification in the fusing cavity, which effectively prevents the fusing cavity from bursting due to excessive fluxing agent 105 under high voltage conditions. On the other hand, the fusible component 106 has a U-shaped structure with two support arms 1061 arranged opposite to each other. When the arc is cut off, a high-strength electromagnetic field is generated, and the electrons repel each other, thereby elongating the arc, and quickly cutting off the arc. Further, the U-shaped fusible component 106 increases the gap surface between the fusible component 106 and the insulation block 1021, thereby increasing the contact surface between the fluxing agent 105 and the fusible component 106, and effectively improving the activation speed of the oxide layer on the surface of the fusible component 106. In this way, the contraction rate of the fusible component 106 is accelerated to realize rapid cutting.

The left pin 103 and the right pin 104 are perpendicular to the two fusible alloy support arms 1061. One end of the left pin 103 is connected to the support arm 1061 at the left side, and the other end of the left pin 103 extends out of the housing 101. One end of the right pin 104 is connected to the support arm 1061 at the right side, and the other end of the right pin 104 extends out of the housing 101. The left pin 103, the fusible component 106, and the right pin 104 form the fusing component of an electrical connection.

Figure 4:
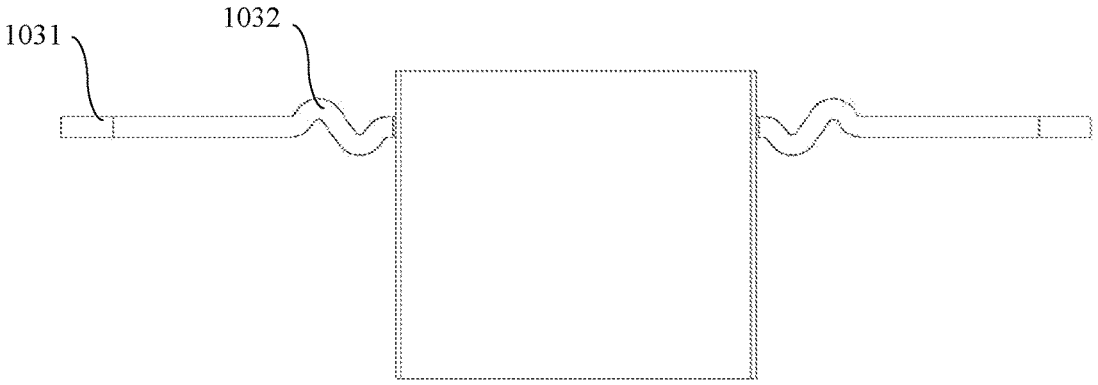
FIG. 4 is a schematic view showing the pins of the high-voltage direct-current thermal fuse according to Embodiment 1 in the present application.

Preferably, as shown in FIG. 4, each of the two pins has the flat end 1031 and the wavy end 1032. The flat end 1031 configured for external connection is away from the fusing cavity, and the wavy end 1032 is close to the fusing cavity.

When the high-voltage direct-current thermal fuse is applied in the thermal protection of a power device in high-voltage circuits, when the power device operates in unusual conditions, the temperature would rise abnormally. The heat is transferred to the fluxing agent 105 and the fusible component 106 through the left pin 103, the right pin 104, and the housing 101, thus transferring the fluxing agent 105 from solid state to liquid state and activating the surface oxide layer of the fusible component 106. When the temperature reaches the operating temperature point of the fusible component 106, the fusible component 106 starts to creep and contract toward the left pin 103 and the right pin 104. When the fusible component 106 is broken, a high-voltage arc is generated, and the opening point of the fusible component 106 is rapidly eroded by electricity. When the fusible component 106 reaches the two opposite support arms 1061 after contraction and electrical erosion, the high electric field intensity generated by the breaking of the fusible component 106 makes the electrons of the two support arms 1061 repel each other, the arc is lengthened, and the arc is rapidly cut off, thus cutting off the circuit. The insulation block 1021 of the bottom plate 102 functions to lengthen the arc and increase the insulation voltage withstanding capability of the left pin 103 and the right pin 104 in the arc extinction.

Embodiment 2

Figure 5:
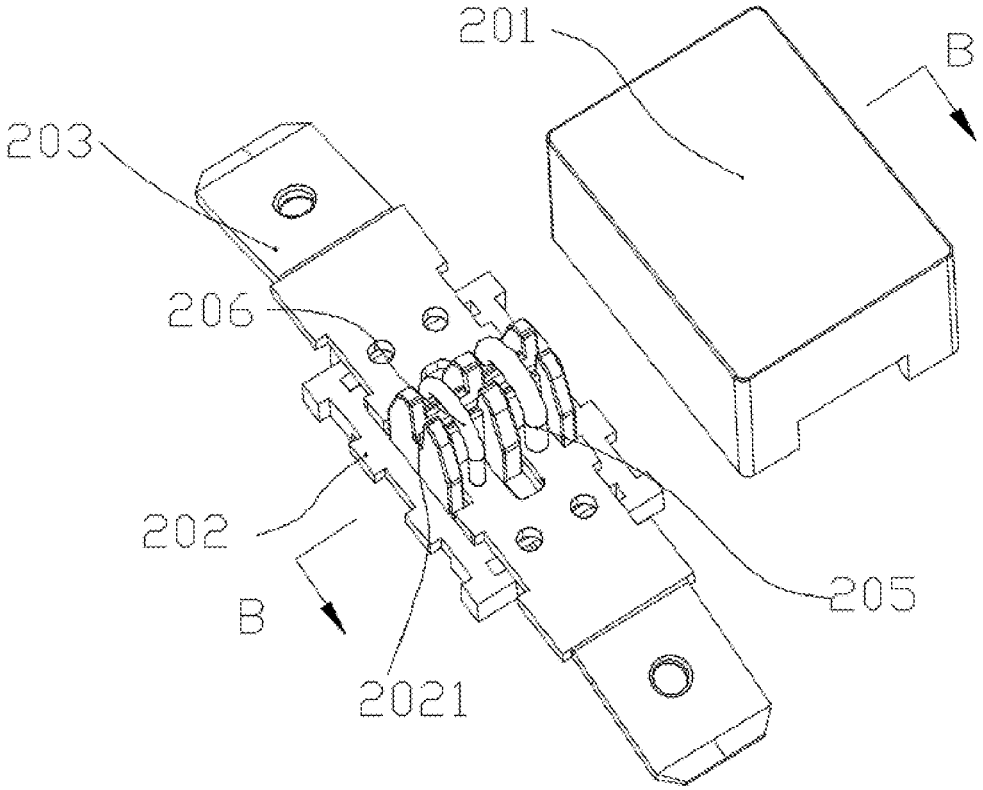
FIG. 5 is a perspective view of the high-voltage direct-current thermal fuse with the housing removed according to Embodiment 2 in the present application.
Figure 6:
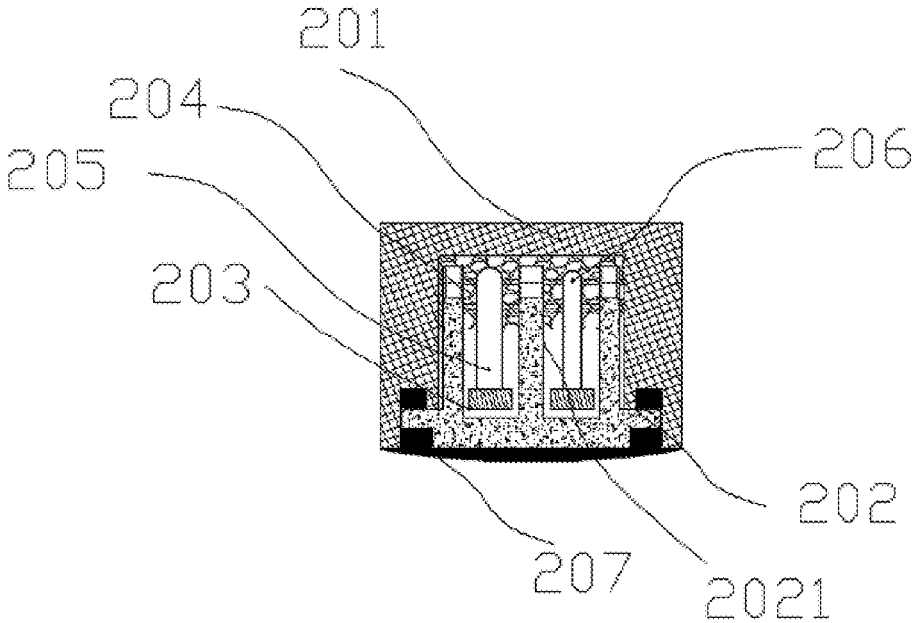
FIG. 6 is a cross-sectional view taken from the line B-B in FIG. 5 according to Embodiment 2 in the present application.

The difference between Embodiment 1 and Embodiment 2 is that: in Embodiment 2, the high-voltage direct-current thermal fuse is provided with two fusible components arranged separately, one of which has higher operating temperature than that of the other one. As shown in FIG. 5 and FIG. 6, the high-voltage direct-current thermal fuse includes the non-metallic housing 201, the bottom plate 202, and the insulation block 2021 arranged on the bottom plate 202. The housing 201 and the bottom plate 202 are sealed with the encapsulation adhesive 207. The housing 201, the bottom plate 202, the pins 203, and the insulation block 2021 form the fusing cavity. The first fusible component 205 and the second fusible component 206 are arranged in the fusing cavity. The fluxing agent 204 is further provided in the fusing cavity, and the volume ratio of the fluxing agent 204 to the fusing cavity is approximately 50% or less. The two fusible components are both a U-shaped structure. The cross-sectional area of the first fusible component 205 is smaller than the cross-sectional area of the second fusible component 206. The operating temperature of the first fusible component 205 is higher than the operating temperature of the second fusible component 206. The other parts and structures are similar to Embodiment 1, which is not repeatedly described herein.

Preferably, the difference between the operating temperatures of the first fusible component 205 and the second fusible component 206 is at least 5° C., so as to ensure the fusible components in the same fusing cavity are fused in order.

Optionally, the high-voltage direct-current thermal fuse includes four fusible components, i.e. the first fusible component, the second fusible component, the third fusible component and the fourth fusible component. The relationship of the cross-sectional areas thereof is: $S_1<S_2=S_3=S_4$, and the relationship of the operating temperatures thereof is $T_1>T_2=T_3=T_4$. Alternatively, $S_1<S_2<S_3<S_4$, and $T_1>T_2>T_3>T_4$.

By doing so, while improving the current handling capability in per unit volume, the ability of cutting off the circuit with high voltage is also improved. The fusible component having a high operating temperature and a small cross-sectional area can contract faster to cut off the arc under the action of the temperature and the current after other fusible components are fused.

It should be noted that the above is one of the embodiments rather than any limitation to the present application.

Embodiment 3

Figure 7:
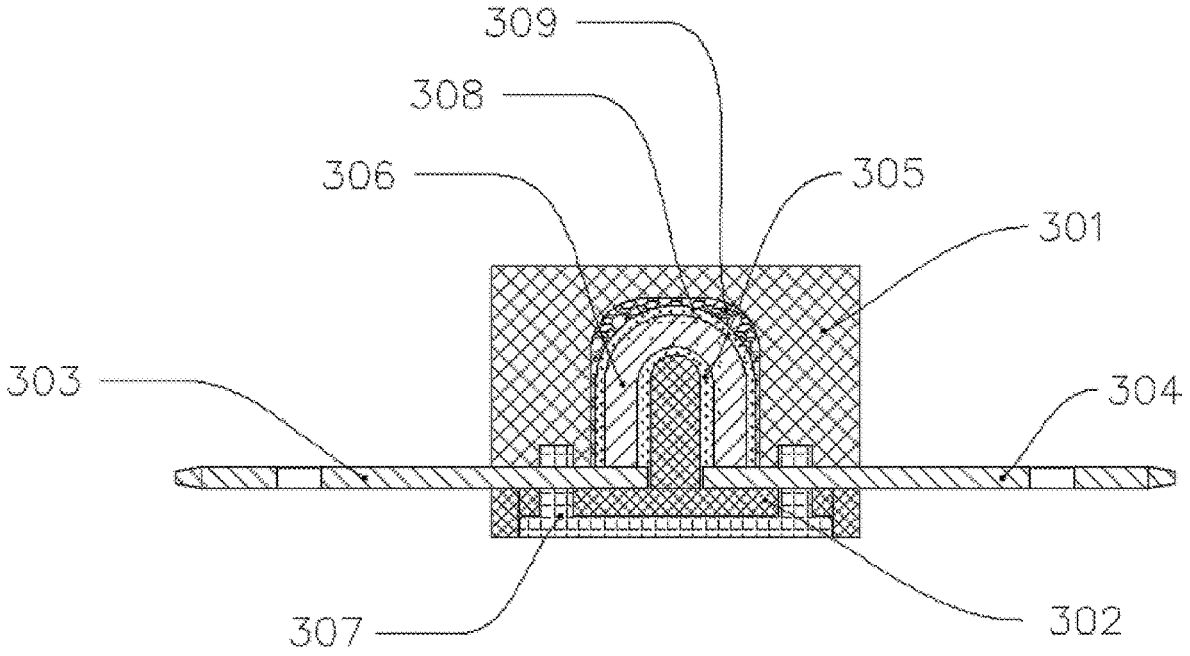
FIG. 7 is a cross-sectional view of the high-voltage direct-current thermal fuse according to Embodiment 3 in the present application.

As shown in FIG. 7, the high-voltage direct-current thermal fuse of this embodiment is based on Embodiment 1 or Embodiment 2. The non-metallic partition film 308 on the outer layer of the fusible component 306 is configured to divide the fusing cavity into an inner cavity and an outer cavity that are mutually sealed. The quartz sand 309 is arranged in the outer cavity, and the fluxing agent 305 is arranged in the inner cavity. The inner cavity and the outer cavity are partitioned to prevent the fluxing agent 305 from penetrating into the quartz sand 309 at a high temperature, and the quartz sand 309 is prevented from penetrating the fluxing agent 305 to destroy the surface structure of the fusible component 306. The other parts and structures are similar to Embodiment 1 or Embodiment 2, which is not repeatedly described herein.

In high voltage application, the arc cutting process easily gasifies and expands the fluxing agent 305. The quartz sand 309 can absorb the impact of gasification and block the transmission path of the arc, which is favorable for improving the insulation withstanding voltage of the opening points. When the fusible component 306 contracts and melts to break, a high-voltage arc is generated. The arc instantaneously and electrically erodes the opening point of the fusible component 306, causing instantaneous gasification and expansion of the fusible component 306 to impact the non-metal partition film 308. Under the action of the impact wave, the non-metal partition film 308 gets fractured, and the quartz sand 309 falls down to cover the fusible component 306, thereby interrupting the high-voltage arc, forming multiple breaking points, and extinguishing the arc instantaneously, which can effectively cut off the circuit.

The present application has been described in detail in the form of embodiments with reference to the drawings. Described embodiments are merely preferred embodiments of the present application and are not intended to limit the present application. Although the present application has been described in detail with reference to the embodiments, for those skilled in the art, the technical solutions described in the foregoing embodiments may be modified, or some of the technical features may be equivalently replaced. Any changes, equivalent substitution, improvement, and so on made without departing from the spirit and principle of this application shall be considered as falling within the scope of this application.

What is claimed is:

1. A high-voltage direct-current thermal fuse, comprising:

a left pin;

a right pin;

at least two fusible components each having two fusible alloy support arms, wherein one fusible alloy support arm is connected to the left pin, and the other fusible alloy support arm is connected to the right pin, wherein the two fusible alloy support arms are arranged opposite from each other;

a fluxing agent;

a fusing cavity, wherein the at least two fusible components and the fluxing agent are sealed within the fusing cavity; and an insulation block, wherein the insulation block is arranged between the two fusible alloy support arms and separates the left pin and the right pin;

wherein a volume ratio of the fluxing agent to the fusing cavity is approximately 50% or less, and wherein a non-metallic partition film is arranged inside the fusing cavity to divide the fusing cavity into an inner cavity and an outer cavity, the inner cavity and the outer cavity are mutually sealed, the fluxing agent is arranged inside the inner cavity, and an arc-extinguishing medium is arranged inside the outer cavity.

2. A high-voltage direct-current thermal fuse, comprising:

one or more fusible components each having two fusible alloy support arms, wherein the two fusible alloy support arms are arranged opposite from each other;

a fluxing agent;

a fusing cavity, wherein each of the one or more fusible components and the fluxing agent are sealed within the fusing cavity;

two pins, wherein the two pins are respectively connected to the two fusible alloy support arms; and an insulation block, wherein the insulation block is arranged between the two fusible alloy support arms and separates the two pins;

wherein, a volume ratio of the fluxing agent to the fusing cavity is approximately 50% or less;

a non-metallic partition film is arranged inside the fusing cavity to divide the fusing cavity into an inner cavity and an outer cavity, the inner cavity and the outer cavity are mutually sealed, the fluxing agent is arranged inside the inner cavity, and an arc-extinguishing medium is arranged inside the outer cavity.

3. The high-voltage direct-current thermal fuse according to claim 2, wherein the volume ratio of the fluxing agent to the fusing cavity is 10%-50%.

4. The high-voltage direct-current thermal fuse according to claim 2, wherein at least one of the one or more fusible components is U shaped.

5. The high-voltage direct-current thermal fuse according to claim 2, wherein the one or more fusible components are at least two fusible components, a cross-sectional area of at least one fusible component of the at least two fusible components is smaller than a cross-sectional area of at least one other fusible component of the at least two fusible components, and an operating temperature of the at least one fusible component is higher than an operating temperature of the at least one other fusible component.

6. The high-voltage direct-current thermal fuse according to claim 5, wherein the at least two fusible components with different cross-sectional areas have an operating temperature difference of more than or equal to 5° C.

7. The high-voltage direct-current thermal fuse according to claim 2, further comprising a housing and a bottom plate, wherein the insulation block is arranged on the bottom plate, and the housing, the bottom plate, the insulation block, and the two pins form the fusing cavity.

8. The high-voltage direct-current thermal fuse according to claim 2, wherein a fusible alloy connection segment is connected between the two fusible alloy support arms, and the two fusible alloy support arms and the fusible alloy connection segment together form a U-shaped structure.

9. The high-voltage direct-current thermal fuse according to claim 2, wherein the two pins are perpendicular to the two fusible alloy support arms.

10. The high-voltage direct-current thermal fuse according to claim 2, wherein the arc-extinguishing medium is quartz sand.

11. The high-voltage direct-current thermal fuse according to claim 2, wherein each of the two pins has a flat end and a wavy end, the flat end is configured for external connection and is away from the fusing cavity, and the wavy end is adjacent to the fusing cavity.

* * * * *